United States Patent [19]

Bergh

[11] 4,246,851

[45] Jan. 27, 1981

[54] FURNACE GRATING

[75] Inventor: John C. Bergh, Elkhart, Ind.

[73] Assignee: Wheelabrator-Frye Inc., Hampton, N.H.

[21] Appl. No.: 84

[22] Filed: Jan. 2, 1979

[51] Int. Cl.[3] ..... F23H 7/08; F23H 17/00

[52] U.S. Cl. ..... 110/281; 110/328; 126/168

[58] Field of Search ..... 110/251, 252, 268, 281, 110/282, 285, 328, 291, 257; 126/157, 167, 168, 174, 175, 179, 180; 122/374–378; 266/178

[56] References Cited

U.S. PATENT DOCUMENTS

| | | | |
|---|---|---|---|
| 149,177 | 3/1874 | Wren et al. | 126/168 |
| 837,641 | 12/1906 | Poppenhusen | 110/281 |
| 1,703,748 | 2/1929 | Porter | 126/180 |
| 1,976,746 | 10/1934 | Regan | 126/180 |

*Primary Examiner*—Charles A. Ruehl

*Attorney, Agent, or Firm*—McDougall, Hersh & Scott

[57] ABSTRACT

Grate bars for the support of floor plates over which combustible material is advanced through a combustion furnace, in which the grate bars are in the form of elongate members arranged in side-by-side relation with alternate bars being movable endwise with means for vertical movement relative to adjacent stationary bars to define walking beams for advancement of the material through the furnace, in which the grate bars are formed of the three elongated rod-like members in triangular arrangement and interconnected by longitudinally spaced bulkheads which support the floor plates.

14 Claims, 7 Drawing Figures

FURNACE GRATING

This invention relates to the conversion of garbage and trash into energy which can be utilized in the production of heat and/or electricity, while enabling the recovery of valuables, such as metals, from a residue that can be safely disposed without exceeding environmental standards for air, water and land.

The described features have been made available in a facility constructed in the United States for conversion of trash and garbage at a rate of 1600 tons per day into thermal energy in the form of steam which is utilized by an adjacent power plant for the production of electricity. A flow diagram of the operating facility is shown in FIG. 1 of the drawings in which trash and garbage collected from adjacent communities is carried by truck 10 to an unloading dock 12 and dumped into a bunker 14.

The refuse is lifted from the bunker by a bucket 16 of a crane 18, which transfers the refuse to a feed hopper 20 from which the refuse is fed by a vibratory conveyor 22 onto a short feed chute 24 for introducing the refuse into the furnace 26. The refuse in the chute 24 forms an air seal between the interior of the furnace and the outside atmosphere for blocking the escape of heat and fumes from the furnace. This feed chute is water cooled to avoid ignition of the refuse in this area.

The refuse proceeds into and through the furnace over a series of downwardly inclined grates vertically spaced one below the other with a slight overlap between the trailing end of the upper grate and the leading end of the lower grate for continuous flow from one grate to the other through the furnace. The uppermost grate 30 is a drying grate having a length of about 7 feet, the intermediate grate 32 is a burnout grate having a length of about 15 feet whereon most of the combustion of the combustible refuse takes place, and the lowermost grate 34 is the riddling grate having a length of about 15 feet where burning of the refuse still takes place but at a much slower rate. The vertical spacing (about 4 feet) between the grates serves to turn and loosen the refuse as it falls from one grate to the other, thereby to achieve more complete combustion. In the preferred practice, the grate 30 is omitted and the grate 24 becomes the drying grate, with the leading end of the riddling grate underlying the trailing end of the drying grate.

The residue remaining on the trailing end of the lowermost grate 34 falls through a clinker hopper 36 into a water sluice 38 for transfer by a clinker chain or screw 40 to a screen 42. The screen allows the fluid component to drain therethrough while feeding the solid residue to a magnetic separator 44 which recovers ferrous metal components while the solid remainder of non-ferrous metals, glass, sand and other non-combustibles can be used for land fill or may be further processed for removal of other valuables, such as non-ferrous metals, before disposal. The final residue will represent less than 10% of the original volume of refuse fed into the furnace.

Combustion air is drawn into the furnace and released below the grates for passage upwardly therethrough in support of combustion. The hot flue gases 50, produced during combustion, are passed in heat exchange relation with steam coils 52 located in a separate boiler but preferably located in the upper portion of the furnace above the grates with water entering through inlet 51 while steam exits through outlet 53. The flue gases are processed through an electrical precipitator 54 for the removal of fly ash and particulates before release from the stack 56 into the atmosphere.

Heat from the combustion of the refuse is utilized to produce steam in the boiler which can be transformed into electrical energy by means of a steam turbine-generator for the generation of power to operate the facility, leaving a vast excess of power available for sale.

The grates which form the floor on which the refuse is carried through the furnace are constructed of a plurality of elongated grate bars, dimensioned to have a length corresponding to the length of the grate section, with the bars arranged in side-by-side relation in each section. Flat floor plates are supported above each bar in edge-to-edge relation to define a substantially continuous surface or floor on which the refuse is supported. Alternate bars are fixed at their ends to crosswise extending frame bars which are adapted to be activated for reciprocal movement in the endwise direction, with means to cause the frame with its connected bars to rise during forward movement to a level above the adjacent fixed bars, and to lower during return movement thereby to define a walking beam effect for stepwise advancement of the refuse along the grates and through the furnace. Various means can be employed for reciprocal movement of the frame and bars, such as a hydraulic piston and cylinder assembly in which the piston rod connects with a pin pivotally connected at its forward end to the frame member as described in my copending application filed concurrently herewith and entitled Mechanical Actuation of Furnace Grate Bars, which application is incorporated herein by reference.

The means for guiding the frame and bars for movement vertically is illustrated in FIGS. 4 and 5 as inclined slide chutes fixed to longitudinally spaced-apart portions of the movable bars to extend from the underside thereof at a slope of about 10°. The sloping or cam surfaces are adapted to ride on abutments which are fixed in corresponding spaced relation to either the stationary bars or the frame of the furnace whereby the movable bars are raised during forward movement in response to the cam action between the sloping surfaces of the slide chutes and the fixed abutments and to drop back down during return movement of the movable bar assembly.

The alternating movable and stationary grate bars are each formed of elongated, vertically disposed, laterally spaced-apart strips of alloy metal joined one to the other in spaced parallel relation by bulkhead plates which extend crosswise between longitudinally spaced portions of the strips, each bulkhead having a portion extending upwardly beyond the upper ends of the strips with horizontally disposed flanges extending from the upwardly projecting portions for support of the floor plates laid thereon.

Grate bars of the described construction have been subjected to a number of deficiencies which lead to less efficient operation or breakdown which require expensive shutdowns of the furnace over extended periods of time for replacement or repair.

Anything that will extend the time for continuous operation would, of course, be of economic importance and any factors that would improve the efficiency of combustion as well as continuity of operation would materially enhance the utilization of the equipment and its profitability.

Thus, it is an object of this invention to provide an improved grate bar assembly which provides for increased strength, particularly in the load-carrying plane; which provides greater resistance to buckling and increase in the duration for continuous operation between shutdowns for replacement or repair; in which the corrosive impact by reason of overheating underneath the grates, coupled with the corrosive vapors generated during combustion, is materially reduced with resultant decrease in frequency of shutdowns for replacement or repair; in which air in axial flow about the grates is materially increased and made more uniform due to lower flow resistance about the grate bars; and in which a self cleaning effect is obtained due to the configuration of the grate bars embodying the features of this invention.

These and other objects and advantages of this invention will hereinafter appear, and for purposes of illustration, but not of limitation, an embodiment of the invention is shown in the accompanying drawings in which.

Figure 1:
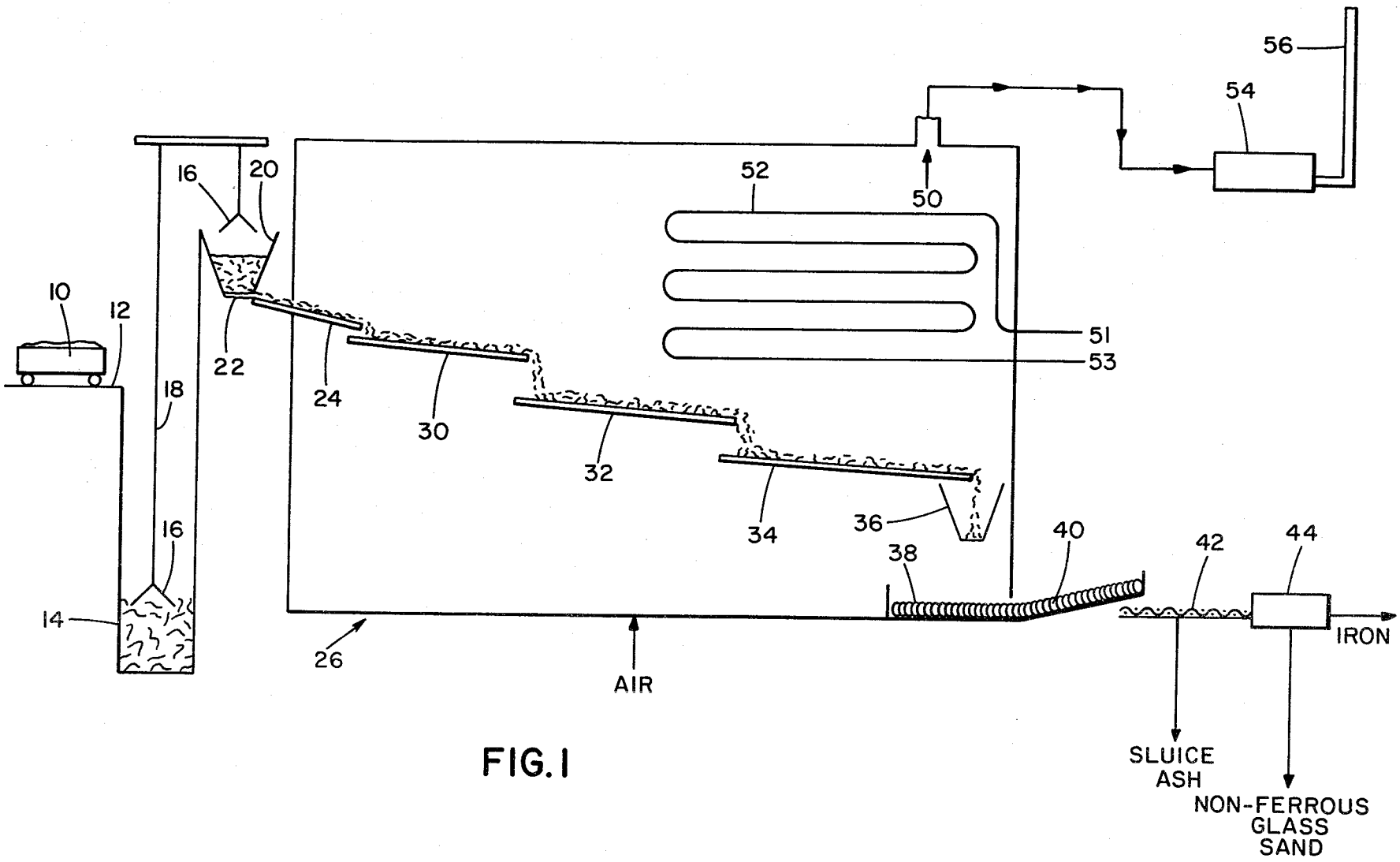
FIG. 1 is a flow diagram of the system for conversion of trash and garbage into utilizable energy with accompanying recovery of valuables and marked decrease in the volume of material for disposition.
Figure 2:
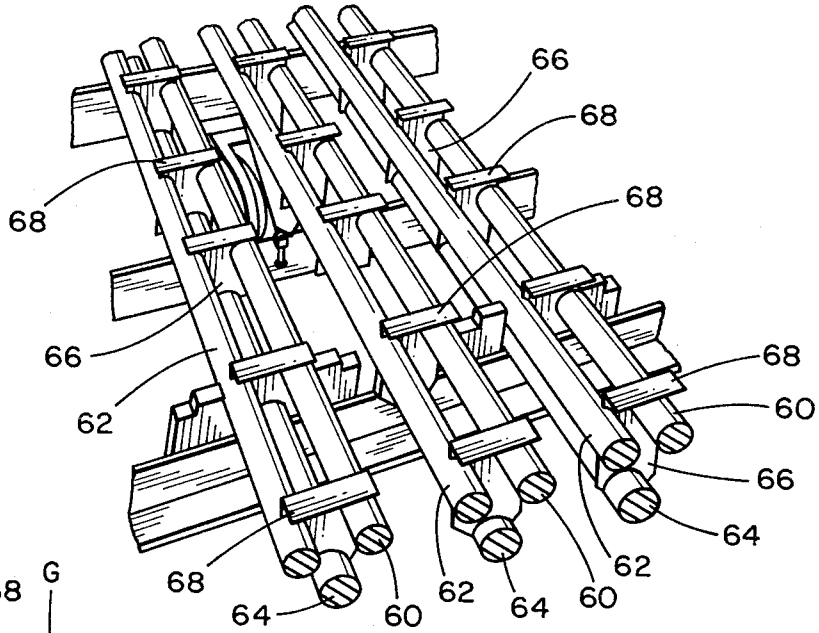
FIG. 2 is a perspective view of the grates, showing the grate bars of this invention in position of use, but without the floor plate covers on the grate bars.
Figure 3:
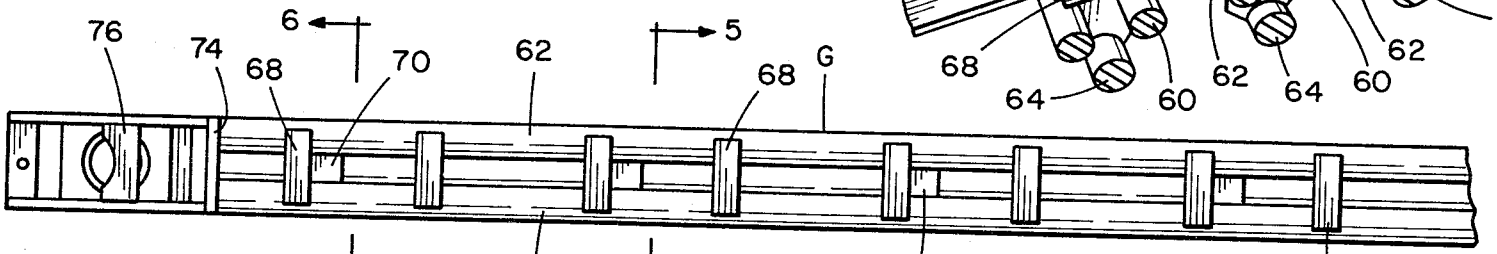
FIG. 3 is a top plan view of the movable grate bar.
Figure 4:
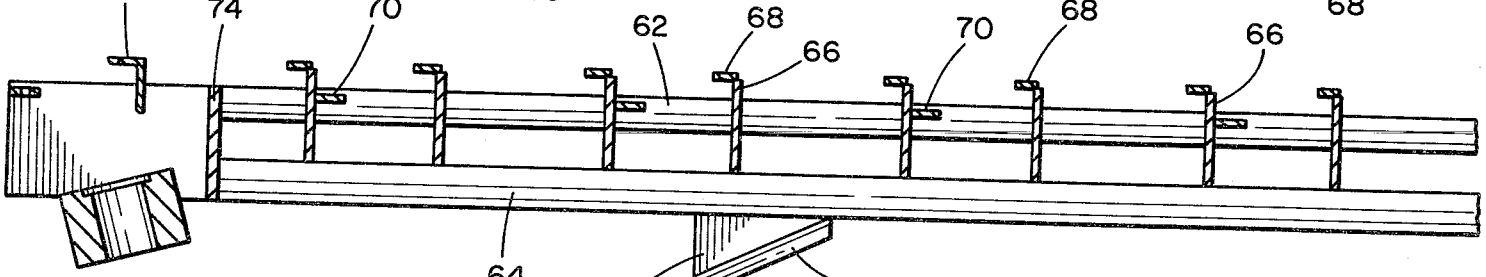
FIG. 4 is a sectional view taken along the line 4—4 of FIG. 3 and which also shows floor plate covers mounted in position of use.
Figure 5:
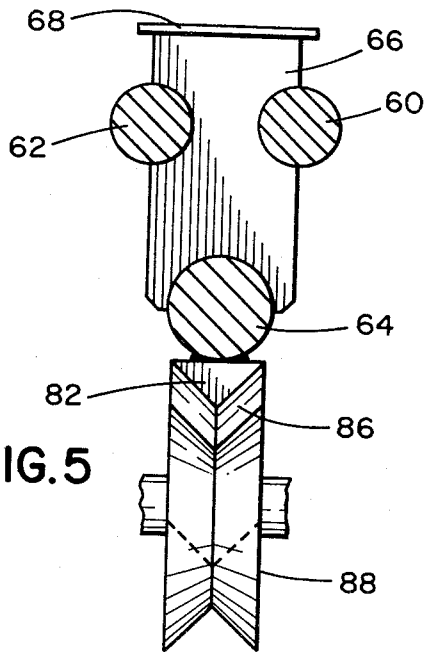
FIG. 5 is a sectional view taken along the line 5—5 of FIG. 3.

The invention will hereinafter be described with particular reference to the grate bars G for both the movable and fixed grates, since the construction and operation of the remainder of the apparatus is otherwise substantially the same as that in present commercial construction and operation.

In accordance with the practice of this invention, the grate bars G are formed of three separate elongate rods 60, 62, 64 of curvilinear, and preferably circular, cross section, in which the bars are arranged at positions corresponding to the corners of an isosceles triangle with the base of the triangle uppermost.

The two uppermost rods 60 and 62, at the corners of the base, are of lesser cross section than the lower rod 64 located midway between the upper rods and spaced downwardly therefrom. The rods extend in parallel relation and are dimensioned to have a length corresponding to the length of the grate for continuous extension from the lead end to the trailing end of the grate.

A plurality of vertically disposed bulkheads 66 extend crosswise between the bars in longitudinally spaced apart relation and are fixed to the bars, as by welding, whereby the bars are joined as a beam in a fixed assembled relation. The bulkheads 66 extend for a short distance above the uppermost pair of rods and are provided with a rearwardly extending flange 68 at their upper ends while alternate bulkheads are also provided with a flange portion of shelf 70 which extends forwardly a short distance from the upper ends.

Figure 7:
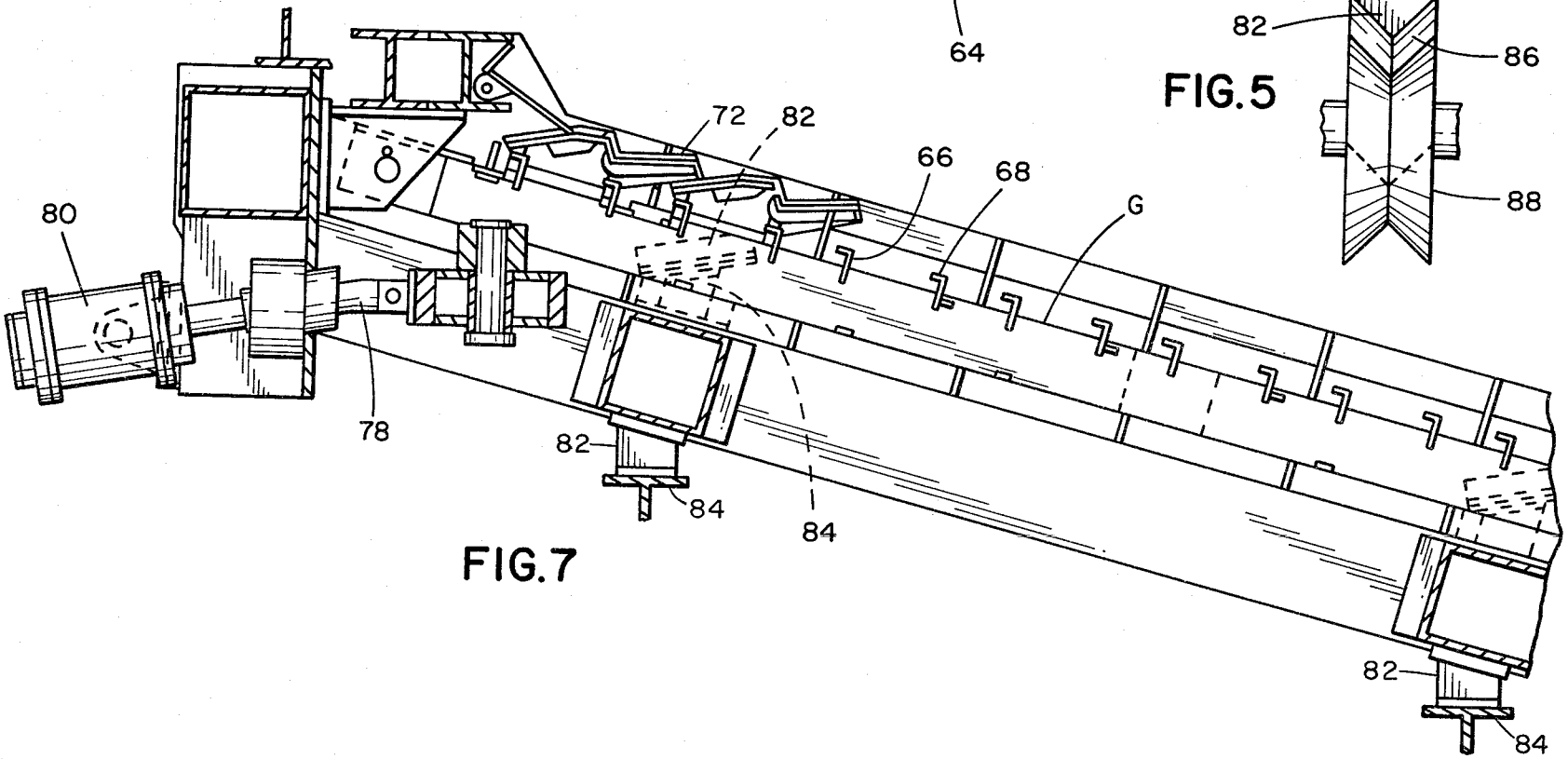
FIG. 7 is a side elevational view which illustrates a means for reciprocal movement of the movable bar assembly.

Since the invention is concerned primarily with the construction of the grate bars and not with the floor plate covers 72, detailed description thereof (FIG. 7) will not be given. Suffice it to say that floor plate covers of various designs can be provided removably to be mounted movable and stationary grate bars for movement with the movable grate bars. The floor plate covers are dimensioned to span the space between the bars, with a sufficient spaced relation therebetween to enable flow of combustion air from the area below the grates to the area above the grates during combustion of the garbage and trash being displaced over the surfaces thereof.

Figure 6:
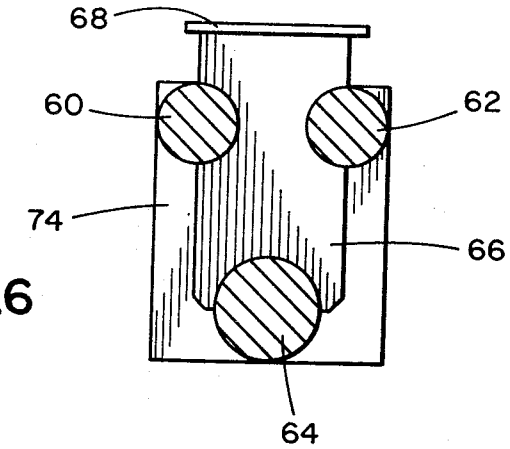
FIG. 6 is a sectional view taken along the line 6—6 of FIG. 3.

As illustrated in FIG. 6, the trailing end portions of the movable bars are joined by a U-shaped frame member 74 for attachment to a crosswise extending main frame plate 76 which joins a group of the movable bars into one assembly for conjoint reciprocal movement in response to activation by a ram rod 78 extending from a hydraulic cylinder 80 mounted on the furnace wall.

Reference is made to a co-pending application Ser. No. 000,083 filed concurrently herewith on Jan. 2, 1979 and entitled "Mechanical Actuation of Furnace Grate Beams" for a description of a means for actuating the movable bar assembly. Suffice it to say that, in response to fluid forces operating within a cylinder or cylinders, the piston rod or rods are displaced forwardly and rearwardly endwise in connection with the frame of assembled movable grate bars of the type described.

In the illustrated modification, movable bars adjacent the lateral edges of the assembly are provided with slide plates 82 fixed as by welding to the underside of the lowermost rods 64 adjacent both the leading and trailing ends thereof. The slide plates 82 are provided with a bottom edge having an upward slope of about 8°-20° and preferably about 10° with the sloping edges of the bars resting on abutments 84 fixed to a stationary frame whereby the assembly of movable grate bars rise during forward movement in response to the camming engagement between the slide plates 82 and the abutments 84, with the reverse occurring during return of the assembly to the rearward position. In the alternative, the abutments may be provided on the movable bars in operative engagement with cam surfaces fixed to the furnace frame of stationary bars.

The moving grates which rise and fall relative to the fixed grates operate to dry, tumble and mix the trash and garbage thereby to provide for greater exposure of burnable elements as the trash and garbage are displaced progressively forwardly over the surfaces of the upper drying grate, the middle burnout grate and lower riddling grate.

The fixed grate bars are also joined in a corresponding assembly which is supported in fixed relation on suitable supports (not shown) built into the furnace.

In a preferred practice of this invention, instead of making use of slide plates 82 in camming engagement with fixed abutments 84, use is made of slide plates 82 having a beveled lower edge 86 with the previously described slope and wheels 88 mounted for rotational movement about an axis fixed to the stationary frame whereby the slide plate 82 rides in the peripheral groove of the wheel thereby to decrease frictional wear and the chances of bonding. This results in a smoother and more uniform movement of the assembly of movable grates.

The grate bars, including the rods and bulkheads, are formed of a high strength corrosion resistant metal, such as an alloy steel of the type known as WR steels, INX-50 steels or A-36M steels and the like.

The upper rods may be selected to have a diameter within the range of $\frac{3}{4}''$ to $1\frac{1}{2}''$ and preferably about 1" while the lower rod is selected to have a diameter within the range of $1\frac{1}{2}''$ to 3" and preferably about 2".

The circular rods, joined to the bulkheads, form a type of elongate strut characterized by high strength, especially in the load carrying plane thereby to resist buckling and distortion even when exposed to excessive forces and temperatures such as 800° C. which may sometimes occur below the grates.

The rounded design of the bars making up the grate bars provides for decrease in surface area per linear foot of beam which is exposed to high temperature and corrosive gases while providing increase in cross section thereby materially to increase the useful life of the grates.

The rounded rods provide less resistance to air flow which allows for better and more uniform axial flow of combustion air around the bars and into the combustion area above the plates.

Because of the diverging arrangement of the rods making up the grate bars, the bars tend to become self cleaning while the free area for passing riddling is smaller.

In effect, the number of shutdowns for replacement or repair has been materially reduced by the improvement in the construction of the grate bars in accordance with the practice of this invention, whereby marked improvement in the output and efficiency of the conversion unit has been achieved, and can be sustained.

It will be understood that changes may be made in the details of construction, arrangement and operation without departing from the spirit of the invention, especially as defined in the following claims.

I claim:

1. Grate bars for the support of floor plates over which material is advanced through a furnace, in which the grate bars are in the form of elongate members arranged in side-by-side parallel relation in the furnace, said grate bars comprising elongated rods of curvilinear cross section in triangular arrangement, longitudinally spaced apart bulkheads extending crosswise for engaging the rods in an assembled relation to form a beam, said bulkheads having portions extending upwardly above the uppermost of the rods for support of the floor plates.

2. Grate bars as claimed in claim 1 in which the rods are three in number in triangular arrangement with the base of the triangle uppermost.

3. Grate bars as claimed in claim 2 in which the two rods uppermost in the triangular arrangement are in laterally spaced apart parallel relation with the third rod spaced below and midway in between.

4. Grate bars as claimed in claim 2 in which the upper rods are of lesser cross section than the lower rod.

5. Grate bars as claimed in claim 2 in which the rods are of circular cross section with the upper rods being of a diameter less than the diameter of the lower rod.

6. Grate bars as claimed in claim 5 in which the diameter of the lower rod is greater than the spaced relation between the upper rods.

7. Grate bars as claimed in claim 1 which includes means on the portions of the bulkheads extending above the rods for support of the floor plates.

8. Grate bars as claimed in claim 7 in which the portions of the bulkheads extending above the rods for support of the floor plates comprises a rearwardly extending substantially horizontal portion on the upper ends of the bulkheads.

9. Grate bars as claimed in claim 8 which includes a forwardly extending shelf portion spaced a short distance below the upper end.

10. Grate bars as claimed in claim 1 which includes means for displacement of some of the bars vertically relative to the others responsive to endwise displacement of said bars for forward movement of material supported on the floor plates.

11. Grate bars as claimed in claim 10 in which said means comprises longitudinally spaced apart cam surfaces and stationary abutments in operative engagement with said cam surfaces, one of which is fixed to the movable bar and the other of which is stationary, whereby the movable bar rises during displacement in the forwardly direction and lowers in response to return movement.

12. Grate bars as claimed in claim 10 in which the movable bars and stationary bars are alternately arranged in side-by-side relation.

13. Grate bars as claimed in claim 12 which includes a main frame plate extending crosswise of the ends of a plurality of said movable grate bars, and a connection between the ends of said movable bars and the main frame plate for conjoint movement as an assembly.

14. Grate bars as claimed in claim 13 in which means for endwise movement of the movable bars comprises means for movement of the main frame plate for conjoint movement of the bars.

* * * * *